US006481145B2

(12) United States Patent
Weichert et al.

(10) Patent No.: US 6,481,145 B2
(45) Date of Patent: Nov. 19, 2002

(54) GRENADE LAUNCHER

(75) Inventors: Berthold Weichert, Oberndorf (DE); Jürgen Gablowski, Oberndorf (DE); Gerhard Gielke, Oberndorf (DE)

(73) Assignee: Heckler & Koch GmbH, Obernforf/Necker (DE)

( * ) Notice: Subject to any disclaimer, the term of this patent is extended or adjusted under 35 U.S.C. 154(b) by 0 days.

(21) Appl. No.: 09/778,127

(22) Filed: Feb. 6, 2001

(65) Prior Publication Data

US 2001/0042334 A1 Nov. 22, 2001

(51) Int. Cl.[7] ..... F41C 27/06
(52) U.S. Cl. ..... 42/105; 42/75.02; 42/12
(58) Field of Search ..... 42/105, 77, 75.02, 42/12, 13

(56) References Cited

U.S. PATENT DOCUMENTS

| | | | | | |
|---|---|---|---|---|---|
| 193,906 | A | * | 8/1877 | Wood, Jr. | 42/105 |
| 3,279,114 | A | * | 10/1966 | Lewis et al. | 42/105 |
| 3,332,162 | A | * | 7/1967 | Martwick et al. | 42/105 |
| 3,507,067 | A | * | 4/1970 | Into | 42/105 |
| 3,557,482 | A | * | 1/1971 | Hoover | 42/105 |
| 3,641,691 | A | | 2/1972 | Ellis et al. | 42/105 |
| 3,967,402 | A | * | 7/1976 | Cooksey | 42/26 |
| 3,967,403 | A | * | 7/1976 | Reynolds | 42/105 |
| 4,689,911 | A | * | 9/1987 | White | 42/105 |
| 5,052,144 | A | * | 10/1991 | Ostor | 42/105 |

FOREIGN PATENT DOCUMENTS

| | | |
|---|---|---|
| DE | 1 944 650 | 3/1971 |
| EP | 0 085 193 A1 | 12/1982 |
| GB | 2 218 191 A1 | 11/1989 |

OTHER PUBLICATIONS

English language abstract of EP 0 085 193 A1.
International Search Report dated May 31, 2000.

* cited by examiner

*Primary Examiner*—Stephen M. Johnson
(74) *Attorney, Agent, or Firm*—Marshall, Gerstein & Borun

(57) ABSTRACT

An attachable grenade launcher is disclosed for installation on a rifle. The launcher has a grenade launching barrel that is pivotable about a stationary pin located near a muzzle of the barrel. The launcher also has a breech housing and a trigger assembly carried by the breech housing. The trigger assembly has a trigger and an impact plate. The launcher has a connection piece with a longitudinal slot. Th connection piece is integrally bound to the breech housing and carries the stationary pin. The connection piece circumferentially encapsulates the grenade launching barrel over at least a part of its length in such a manner that permits the grenade launching barrel to pivot about the stationary pin between a swung out position and a non-swung out position.

17 Claims, 5 Drawing Sheets

GRENADE LAUNCHER

RELATED APPLICATION DATA

This patent is a continuing application claiming priority from related co-pending international application Serial No. PCT/EP00/05000, filed on May 13, 2000.

FIELD OF THE INVENTION

The present invention relates generally to grenade launchers, and more particularly to an attachable grenade launcher for installation on a rifle.

BACKGROUND OF THE INVENTION

A grenade launcher mounted on a rapid-fire rifle, such as on an M16 U.S. rifle, has been disclosed in U.S. Pat. No. 3,641,691. The grenade launcher is placed beneath the rifle barrel at the location of the forward stock, or, in the '691 patent, where the hand guard is installed. The barrel extends somewhat parallel to the rifle barrel and bears beneath its muzzle a horizontally aligned transverse pin. The barrel with its back section can be swung downward about the pin. In the shooting position of the grenade barrel, there is a non-movable breech housing on the back section that forms an impact plate. A firing pin arrangement is installed into this plate. A trigger member extends downward from the pin arrangement.

For activating the trigger, the magazine of the rifle is seized with the right or left hand as though it were a handle. However, the magazine presents a poor handle because, when seated in place, it has, at most, a little play. Because of this, one would find it as being an unreliable support for the hand. Moreover, the recoil presses the sharp cornered magazine into the encompassing hand, which can be painful. Further, this can overload securement of the magazine.

The transverse pin and the breech housing are bound together by a relatively thin strip. The back end of the barrel is, when in the firing position, releasably engaged in the breech housing.

For the release of the barrel, a locking device is first unlocked and the barrel with its rear section is swung downward. During the unlocking procedure, the firing pin assembly is already cocked. Upon break-away of the barrel, a complex ejection mechanism is set in motion which is supposed to automatically and completely eject the fired cartridge shell by action of a spring. As a practical matter, it is usually sufficient that the ejection mechanism loosens the shell enough so that it subsequently can be removed completely by thumb and one finger without difficulty. The ejection mechanism is additionally attached to the thin strip, which weakens the structural strength or the strip.

The known attachable grenade launcher possesses certain disadvantages which cause it to be unsafe and unreliable. As do all attachable, swing-out weapons with self locking devices, the known grenade launcher has the disadvantage that the firing pin assembly is necessarily locked upon reload. The loaded grenade launcher, because of this, has a continually locked firing pin assembly. An expensive safety apparatus is thus required in order to prevent a shot from being involuntarily released. Such an involuntary shot can be caused by accidental activation of a safety catch and/or by a touch off of a hair trigger response, such as, for instance, by a branch during movement through a bushy area.

The above problem does not concern the known grenade launcher disclosed in U.S. Pat. No. 3,507,067. This launcher possesses a trigger lock which locks the firing pin assembly only upon firing. For reload of this grenade launcher, the barrel is moved forward in a straight line with respect to the stationary breech housing.

Use of the rifle magazine as a handle is still a problem with the disclosed launcher in the '067 patent. Further, swinging of the barrel downward is not especially favorable, particularly when the marksman is positioned in a fox hole. In this case, the rifle rests, as a rule, with the forward part on a raised support, which requires that for reload, the grenade launcher must first be raised or turned to the side.

Particularly disadvantageous is the removal of the empty cartridge, because it often jams and must be loosened by a bayonet or a similar tool. Because of reasons that are not immediately evident, the ejector mechanism has proved to be fully unreliable. Even greasing of the cartridge—without doubt, a problematic solution because of contamination—does not render much aid. Many times, the ejector mechanism does not succeed in even loosening the cartridge shell to the extent that it can be removed by hand, to say nothing of a total ejection.

BRIEF DESCRIPTION OF THE DRAWINGS

An exemplary apparatus constructed in accordance with the teachings of the present invention is described and explained in greater detail below with the aid of the drawing figures in which.

DETAILED DESCRIPTION OF THE PREFERRED EMBODIMENTS

An attachable grenade launcher is disclosed for installation on a rifle, preferably an assault rifle. The launcher generally has a grenade launching barrel pivotable about a vertical pin which is immovably affixed on the rifle and located proximal to the region of the launcher muzzle. The launcher also has a breech housing which carries a trigger assembly, a trigger, and an impact plate. The grenade launcher also has a connection piece encompassing the vertical pin and connected to the breech housing.

All the positional and directional references used herein, such as "above", "horizontal" and the like, are in reference to a rifle with an attachable grenade launcher that, when in the normal shooting position, is held in a horizontal firing direction. "Forward" indicates in the direction of firing. The attachable grenade launcher is preferably installed beneath the barrel of the rifle and terminates before the magazine of the rifle. Other methods of attachment are, however, possible and in some cases, can be advantageous.

All figures relate to the same exemplary apparatus disclosed herein. In all figures, the same reference numbers identify identical elements. Some reference numbers, for the sake of clarity, are not repeated in all of the figures, though they may show some of the same elements.

Figure 1:
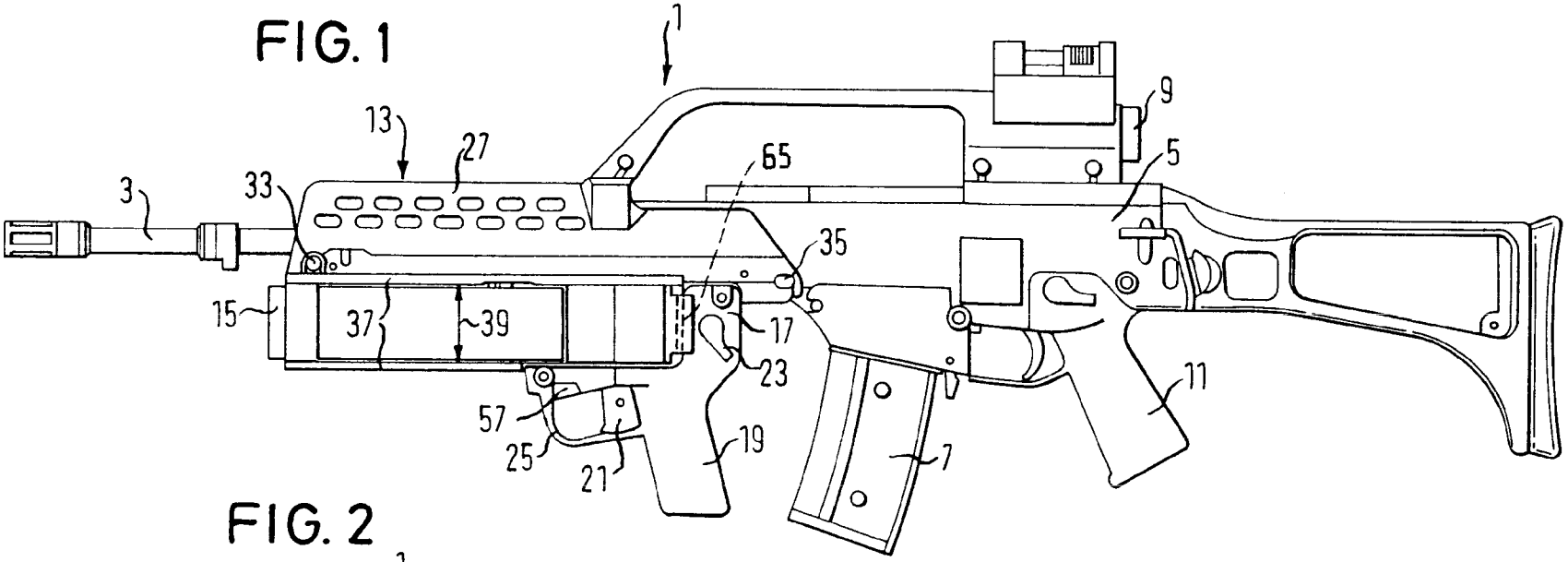
FIG. 1 is a profile view of a rapid fire rifle with an attachable grenade launcher.

Referring now to the drawings, FIG. 1 shows a side view of a modern rapid fire rifle 1 having a rifle barrel 3, a plastic breech housing 5, a magazine 7, an optical sight 9, and a pistol grip 11 with trigger and choice-of-fire lever.

The weapon is designed for a modern, small caliber cartridge that is typically furnished with a small driving charge. This driving charge quantity does not suffice to propel a grenade somewhat similar in action to a hand grenade. If it is desired to fire such a grenade, then a corresponding large caliber discharge cartridge is required. These cartridges are fired in an attachable grenade launcher 13 placed on the rifle. On the rifle 1, the forward part of the stock (not shown) is isolated by a hand guard. Instead of being mounted on the forward stock, the grenade launcher 13 is attached beneath the rifle barrel in the center of a transverse fastening pin 33 and an elongate slot arrangement 35. The slot arrangement 35 is comprised of elongate slots constructed on both sides of the grenade launcher that open to the rear, and that, from the front, are forced onto respective transverse projections which protrude from the breech housing 5 of the rifle.

Figure 2:
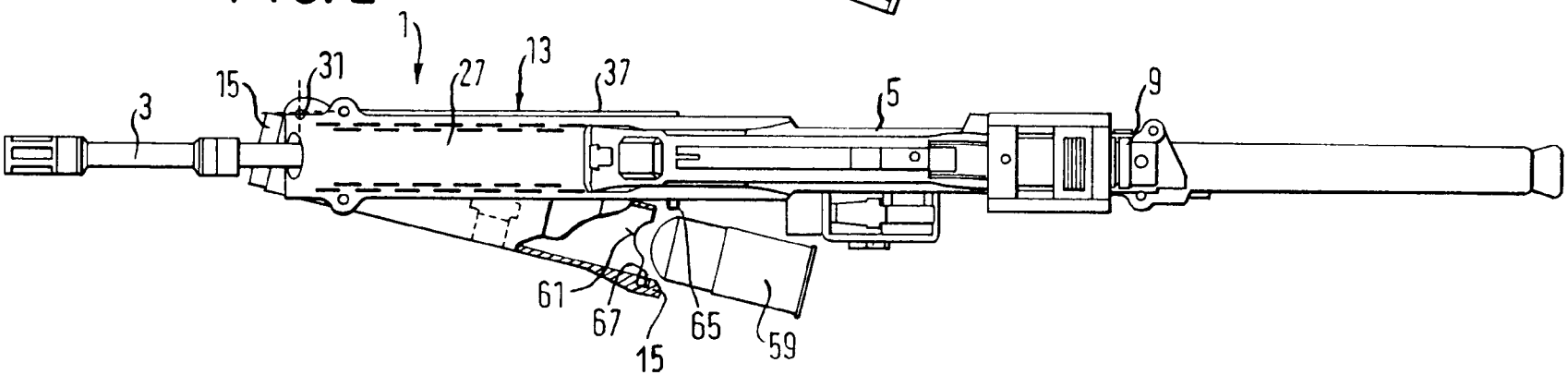
FIG. 2 is a top view onto the weapon of FIG. 1, and showing the grenade launcher in a swung out position.

The grenade launcher 13 has a grenade launching barrel 15 that runs more or less parallel to and beneath the rifle barrel 3. When in the loading position, the grenade launching barrel is swung out to the left, as is shown in FIG. 2.

The grenade launching barrel 15 is secured in a tubelike connection piece 37 that encases the barrel 15 over about three quarters of its circumference and nearly its entire length. The connection piece 37 has on its left side a long slot-like opening 39 again extending over most of its length. This permits the grenade launching barrel 15 to swing therethrough, and away from the stationary connection piece 37.

Figure 3:
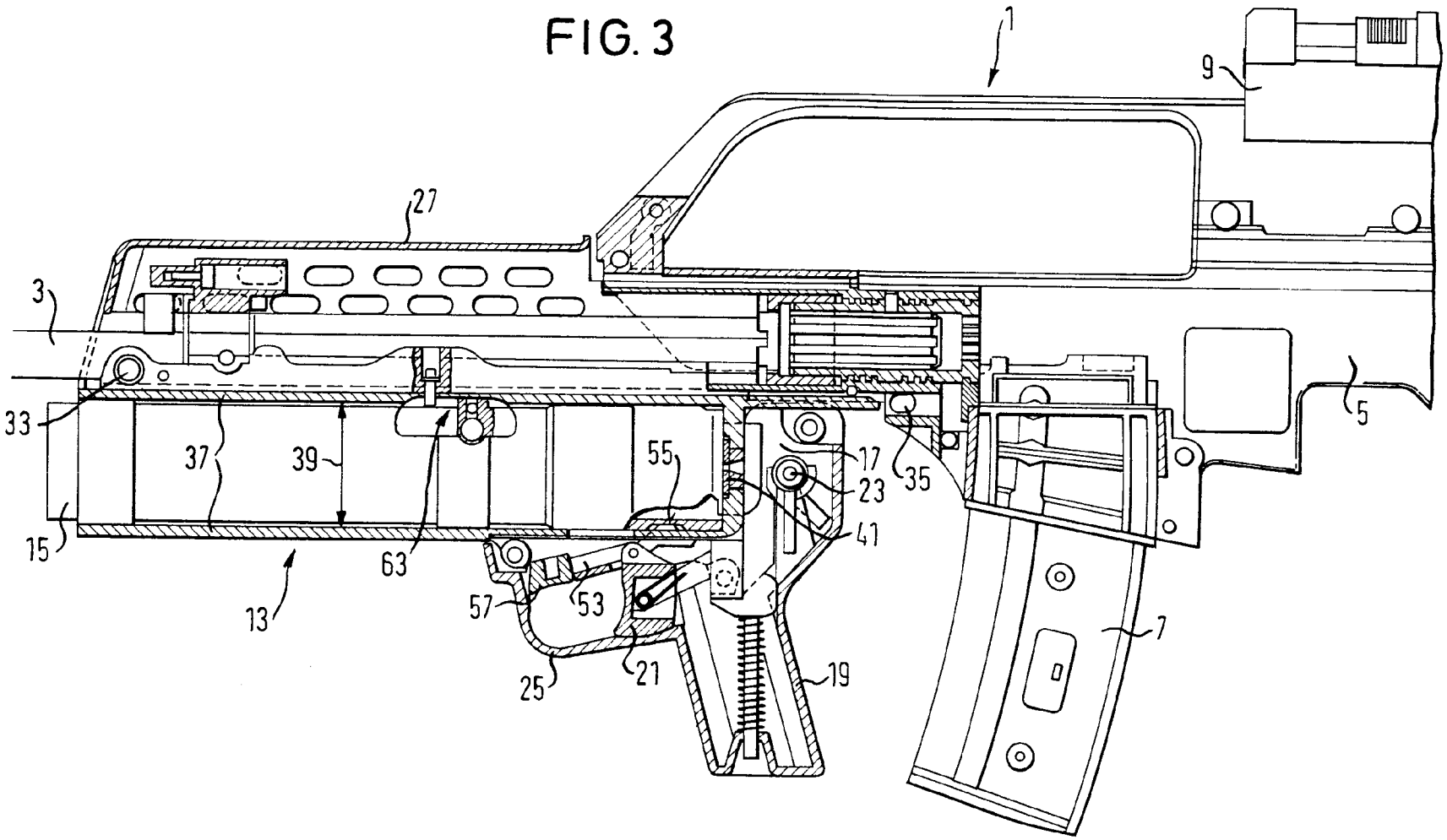
FIG. 3 is an enlarged view of the forward part of a rapid fire rifle with the attachable grenade launcher of FIGS. 1 and 2, and including the handgrip.

The connection piece 37 is bound by a vertical axis pin 31 (FIG. 6) with a breech housing 17 of the grenade launcher 13. The vertical axis pin 31 is on the front side of the connection piece 37 and lies to the right, close beside the grenade launcher barrel 15. The breech housing 17 is placed on the rear side of the connection piece 37 and forms an impact plate abutment 41 (FIG. 3). The breech housing 17 carries a grenade launcher hand grip 19 on its underside which has a trigger safety apparatus with a trigger 2, a firing pin 43 (FIG. 5), and a trigger guard 25.

A safety arrangement 23 is formed by a pin which penetrates transversely through the grenade launcher hand grip 19. An operating or safety lever 23 is on both ends of the pin and respectively on the outsides of the grenade launcher hand grip 19 to activate the safety arrangement. One of the two safety levers 23 can be operated with the hand which circumferentially grasps the hand grip 19 of the grenade launcher 13. This can be done with equal ease using either the right or left hand. The pin of the safety lever 23 immobilizes the trigger 21 or the firing pin 43 of the trigger assembly.

Above the connection piece 37 is placed a hand protection construction 27, which surrounds the rifle barrel 3.

The grenade launcher barrel 15 is forced in the direction of the loading position (see FIG. 2) by two swing-out springs 49, which embrace the vertical pin 31 and abut against the connection piece 37 in the reload direction.

Figure 4:
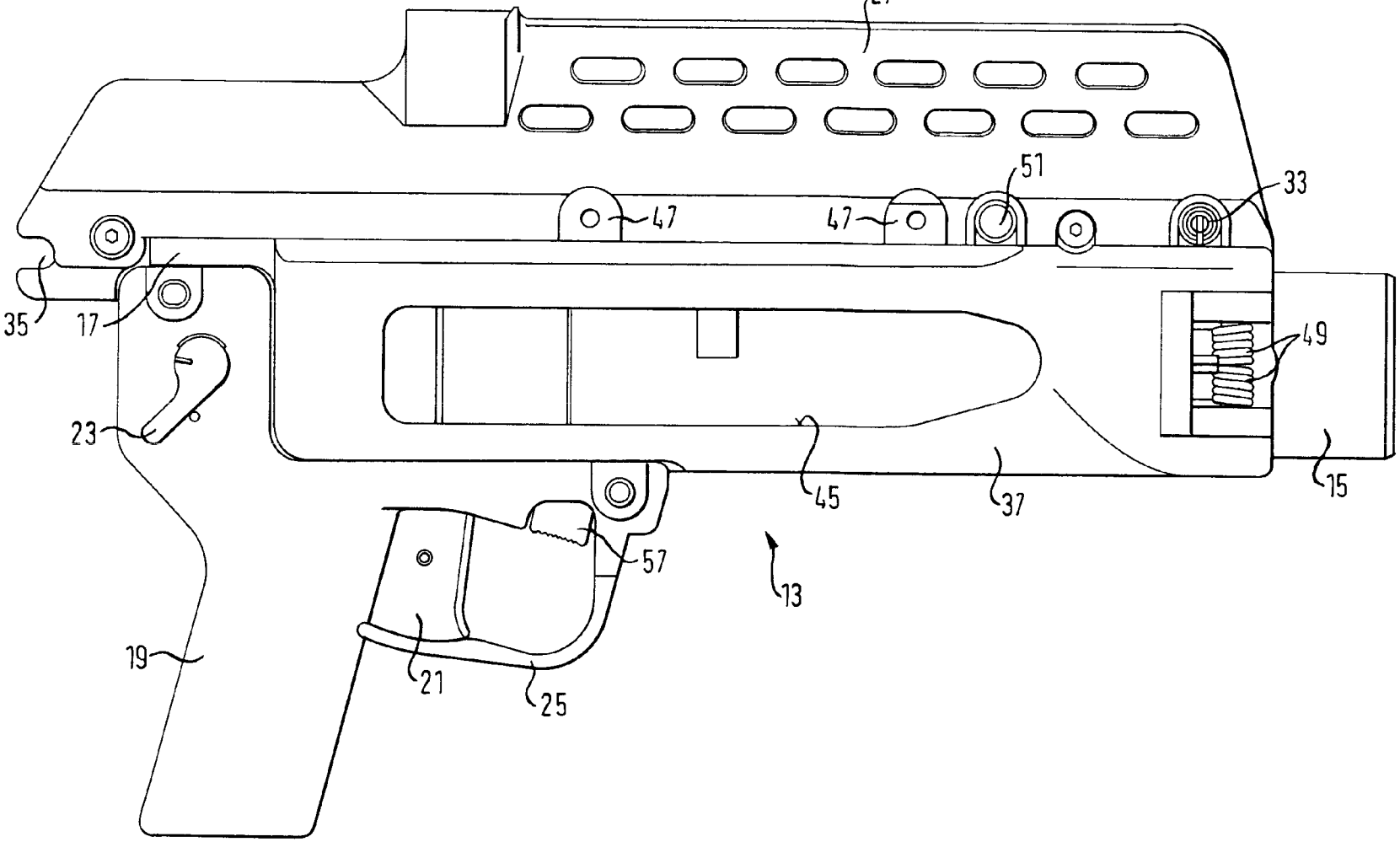
FIG. 4 is a profile view of the attachable grenade launcher shown in FIG. 3, seen from the right and less reduced in scale than in FIG. 3.
Figure 5:
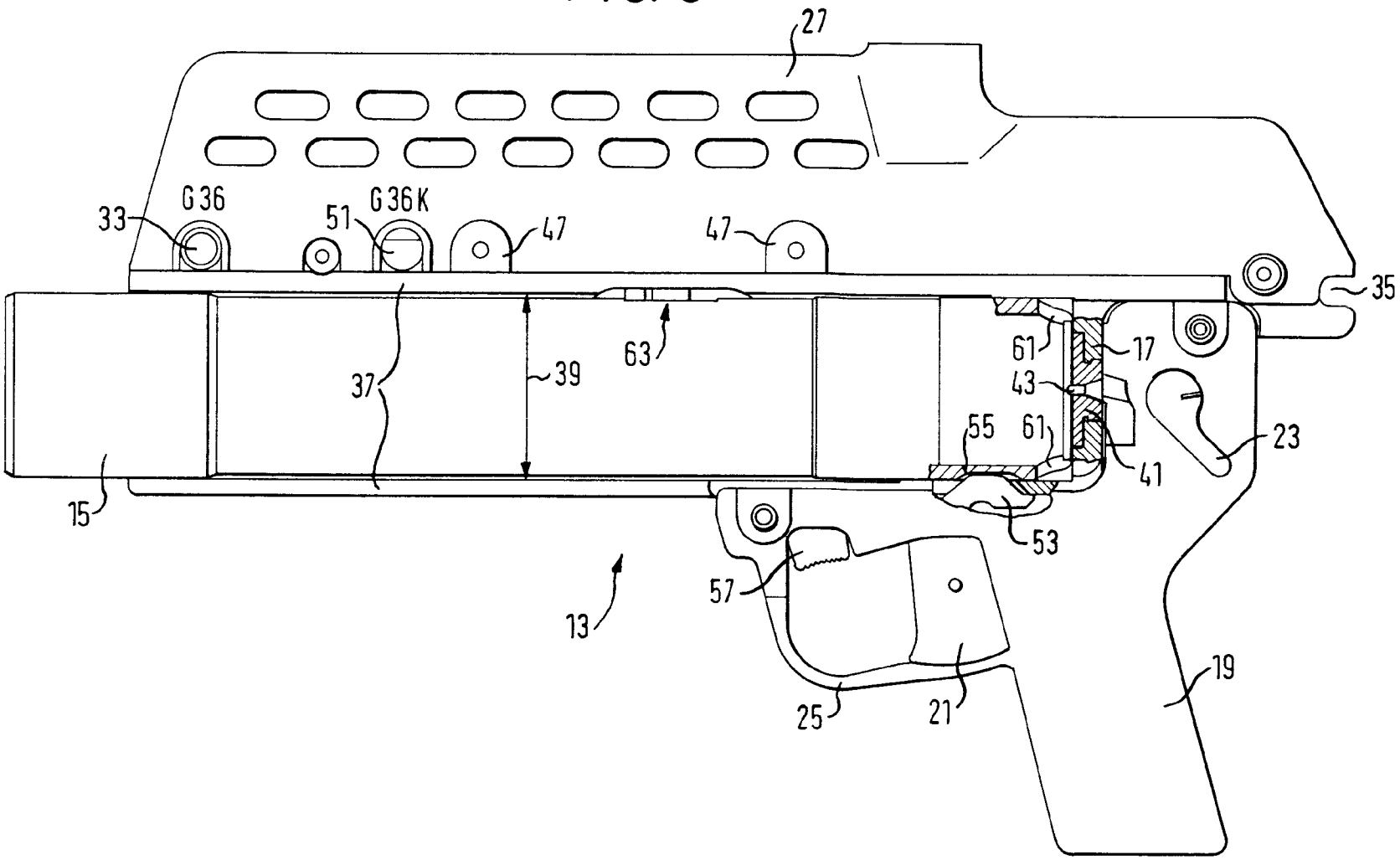
FIG. 5 is a profile view from the left side of the attachable grenade launcher shown in FIG. 4.
Figure 7:
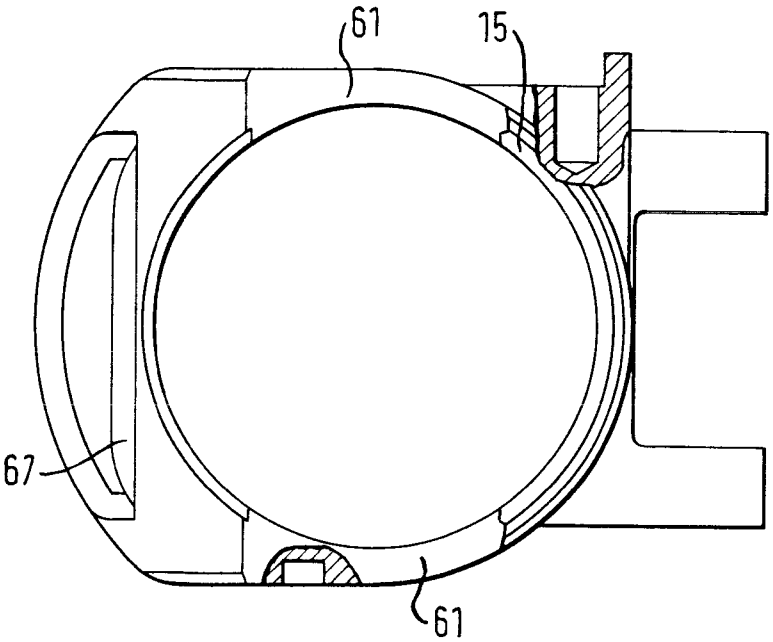
FIG. 7 is an enlarged view from behind the barrel of the attachable grenade launcher shown in FIG. 1.
Figure 6:
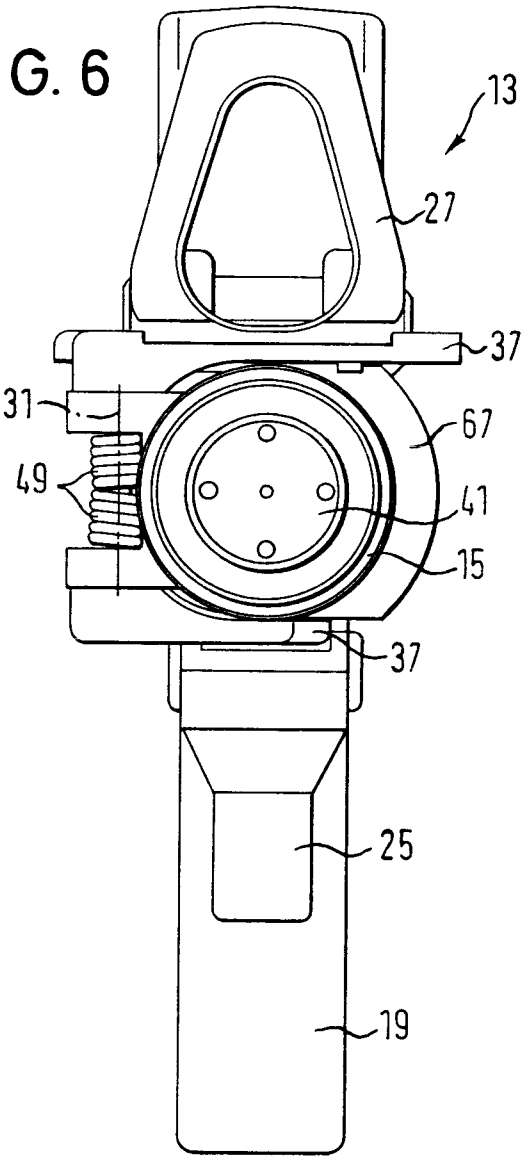
FIG. 6 is a front view of the attachable grenade launcher shown in FIG. 4.

The connection piece 37 has an optional relief opening 45 on its side remote from the longitudinal slot 39 for weight reduction (FIG. 4). As is shown in FIGS. 4 and 5, a sight support 47 is constructed on the upper side of the connection piece 37, and on both sides of the connection piece. The sight support 47 has the form, respectively, of two threaded bolts and a projecting surface which can be continuous or subdivided.

The transverse boring for acceptance of the fastening pin 33 has already been described. However, another transverse boring 51 is shown in FIGS. 4 and 5 and is designed for retaining a fastening pin. This serves for attaching the grenade launcher 13 to an alternative rifle construction, other than that shown in the FIGS. 1–3.

The transverse boring 51 that is not intended for receiving a transverse fastening pin 33 of a particular rifle, is instead closed by a plugging arrangement in order to prevent use of the wrong transverse boring upon mounting the attachable grenade launcher 13 to a particular rifle.

A detent apparatus 63 is provided further along the connection piece 37 against which the grenade launcher 15 strikes upon closure of its barrel.

In the grenade launcher hand grip 19, a tripper 53 is tiltingly and centrally located and has a double bar extending longitudinally and pivoting about a transverse tilt axis. By means of a spring, this tripper 53 is biased upward at its back end, so that the back end enters into a longitudinal groove 55 located at the corresponding back end and below the grenade launcher barrel 15. In this situation, the grenade launcher barrel 15 must be located in its shooting position (FIG. 1).

On the other hand, if the grenade launcher barrel 15 be swung out, (FIG. 2) and then once again swung back into its shooting position, then the back end of the tripper lever 53 collides with the outer circumferential surface of the grenade launcher barrel 15, and is pressed from below thereby, in order to again enter into the longitudinal groove 55.

A pushbutton 57 is located, at the forward end of the tripper lever 53, which projects downwardly between the trigger guard 25 and the trigger 21 from the breech housing 17 and the hand grip 19. Thus, it becomes possible to press the pushbutton 57 upwards with the index finger, thus pivoting the tripper lever 53, until its forward end is released from the longitudinal groove 55 and the grenade launcher barrel 15, driven by the springs 49, swings out into the position shown in FIG. 2. This swinging out is normally executed after pulling the trigger 21 for blocking and activation of the trigger safety apparatus, following a firing.

Subsequently, the spent cartridge case falls out of the barrel 15 either by centrifugal action, or manually by use of the thumb and one finger to seize the case under the cartridge rim and withdraw the case. For this purpose, two oppositely situated, penetrative recesses 61 are provided in the barrel wall at the rear end of the barrel 15, making it possible to grasp the rim of the cartridge case. A separate extraction or ejection device is not supplied. A new cartridge 59 is then inserted into the barrel 15, whereupon the barrel is swung back until the tripper lever 53 again enters into the longitudinal groove 55.

A right handed marksman, using the just described reloading sequence, can leave his right hand on the grenade launcher hand grip 19 and carry out all reloading manipulations with the left hand.

Thus, it is possible to perform an active rapid fire with the grenade launcher, which is especially advantageous when an enemy must be forced into cover in order to achieve a safe change of position for ones own troop. A left handed marksman must reach about in a more complex way to reload, and thus would be a bit slower than a right handed marksman. Since, however, the left handed person is not forced to use his right hand for the trigger, he need not accept any penalty in his firepower.

The breech housing 17 has a vertical strip 65 to the left of the impact plate. In FIG. 2, only the top part of the vertical strip 65 is visible. Complementary to this strip 65, a projection is built out on the rear side of the grenade launching barrel 15 and protrudes from this barrel outwardly and toward the rear. The inner side of this projection exhibits a counter extension 67 which has the form of a vertical groove. The strip 65 and the groove 67 show a surface (not seen) which is part of a cylindrical outer surface about the central axis of the vertical pin 31. The two cylindrical outer surface sections are so conjoined at the pin 31, that upon swinging in of the grenade launching barrel 15, the two coaxially connect as far as possible without play. In this way, the relative position of the barrel 15 and the impact plate 41 on the side of the longitudinal slot 39 remains unchanged upon firing. An additional support for the grenade launching barrel can be dispensed with or eliminated on the right side, because of the tube-like construction of the connection piece 37 (see FIG. 4) and its one piece design, along with the breech housing 17.

FIGS. 4 and 5 disclose a grenade launcher that has, as already mentioned above, at least one surface and two borings on both sides, respectively, which form the holding means for the sight. A frame sight, for example, a scaled ladder sight (not shown), can be installed on either the right or the left sight holder depending upon whether the marksman is right or left handed. In accord with this, the sighting arrangement is adjustably attached. This permits the mounting base to be suitably designed for attachment on an optional side of the grenade launcher 13. Then, the sighting arrangement can be installed with the proper R/L orientation. This launcher sighting arrangement is independent of that of the rifle sight 9.

The grenade launcher barrel 15 and that component formed from the connection piece 37 and the breech housing 17 can be made of light metal. The grenade launcher hand grip can be composed of plastic. The parts of the trigger safety assembly and the impact plate 41 can be fabricated from steel. The attachable grenade launcher 13 is thus relatively light weight, although the weapon is built very ruggedly.

The attachable grenade launcher 13 can, if needed, also be used separate from the rifle 1.

The disclosed attachable grenade launcher 13 has increased stability, is more reliable, and is relatively simple in design. The attachable grenade launcher 13 disclosed herein exhibits a number of features. The connection piece 37 circumferentially encases (at least partially) the barrel 15 and does so over at least a part of its length, so that essentially only one longitudinal slot 39 in the connection piece need be formed. The slot opening is required for swinging out the barrel.

Surprisingly, it has become evident that the above described difficulties with known grenade launchers relating to withdrawal or ejection of cartridge are eliminated in the launcher 13 disclosed herein. The strip or bar that binds together the vertical pin 31 and the breech housing 17 of the disclosed launcher are designed almost totally resistant to bending. The impact plate 41 is likewise installed on the bar in a completely bend resistant manner.

In the case of the known attachable grenade launcher discussed above, the thin strip and/or its connection with the impact plate are springingly distorted during shooting. As this occurs, the breech housing takes on another angular position for a short time relative to the axis of the bore of the barrel. During the shot, however, the cartridge case is plastically distorted (fire-deformed) and subsequently, is again rammed into the cartridge chamber by the spring-back of the impact plate. The cartridge shell is again reshaped and, because of the force of its own resiliency, remains firmly seated in the cartridge chamber.

In contrast, for the disclosed attachable grenade launcher 13 the bearings of the vertical pin 31, the structural bar of the connection piece 37, and the breech housing 17 together form a rigid tube which circumferentially encompasses the barrel. The tube is only slotted to the extent necessary to swing out the grenade launcher barrel. This tube-like connection piece 37 has been tested and found to have sufficient structural rigidity to withstand recoil forces that the cartridge subjects on the breeching plate. Sheathing clamps which are common on conventionally made grenade launchers are not used on the disclosed grenade launcher. Fully sherardized, lacquered steel sheathing is also not used on the disclosed launcher 13.

The disclosed connection piece 37 is heavier than the previously employed thin strip of the known launchers. The weight disadvantage, however, is a small price to pay for the much more meaningful functional safety of the disclosed grenade launcher 13.

In one example of the disclosed grenade launcher 13, the breech housing 17 has a projecting strip 65 running laterally to the elongate, swing out slot 39. The barrel 15 of the grenade launcher 13 exhibits an elongate ridge on the rear side extending to the rear and protruding into the elongate slot. The inner surface of the ridge forms a groove 67 or counter projection that engages the breechblock strip 65 in a structured, complementary fit.

By this means, back-and-forth bending of the impact plate 41 and the grenade launcher barrel 15 in the direction of the elongate slot is prevented, or, at least the tolerance distance between the strip and the counter projection is limited. Even when the grenade launcher 13 becomes worn or loose, caused by heavy, long lasting use under the hardest of conditions, entry of the strip 65 into the counter projection 67 reliably prevents the impact plate 41 from bending away from the end of the barrel breeching at the point where it borders the elongate slot 39.

The strip 65 and the matching counter projection 67 can be made in optional shapes. However, they must assure the integrity of the barrel swing-out and not interfere with reliable seating of the support surfaces of the strip and the counter projection. Preferably, these support surfaces are constructed as circumferential shells of a circular cylinder having axes that are completely, or nearly completely, parallel with the center axis of the vertical pin 31. Thus, it is assured that the support surfaces, upon firing, are pressed against one another and thus provide mutual support.

The tube shaped connection piece 37 extends into the breech housing 17, which carries the tube shape still farther to the rear. It may appear favorable to extend the connection piece 37 forward in a closed cylindrical shape, even forward of the vertical pin 31. However, it is also advantageous that the elongate slot 39 remains open in the forward direction. The connection piece 37, therefore, is not elongate to the front. The weight increase of the disclosed grenade launcher 13, as noted above, is thus somewhat reduced.

For the same reason, the connection piece 37 has at least one, and preferably several, cut-outs 45. These cut-outs do not affect the bending resistance of the connection piece as long as they are in the form of excisions with completely closed peripheries.

The disclosed launcher 13 achieves a further important weight saving measure and an important factor in the improved bending resistance. The cartridge case ejection mechanism or simpler withdrawal mechanism is omitted. Two diametrically opposite openings 61 at the end of the cartridge chamber of the grenade barrel 15 are utilized instead. The connection piece 37, because of this development alone, can be constructed for bending resistance because openings for the ejection mechanism are omitted without substitution. In many cases, through this measure alone, the above described jamming of the discharged cartridge case can be eliminated. By the two openings 61, the discharged cartridge case can be seized by the thumb and one finger of the marksman and pulled out. In this way too, the noisy clanging of the cartridge case on the ground is eliminated, which can give away one's position or location to nearby enemies. This sound will signal to the enemy a change of position of the marksman before reloading. The marksman who grips the empty cartridge case upon reload can lay the cartridge down quietly beside him or put it in his pocket.

The pivot pin in the prior known launchers is horizontally aligned. In the prior launchers, it thus is necessary that the transverse horizontal pin be located not only near the muzzle of the barrel, but also above this it to avoid a collision of the launcher barrel with the rifle barrel which is immediately over it.

Preferably, the pivot pin 31 of the disclosed launcher 13 is arranged with its axis oriented vertically. With the vertical orientation, it becomes possible to mold on or otherwise install a pair of pivoting pins, one each on the upper and underside side of the launcher barrel in the place of the prior horizontal pin. It is, however, advantageous to place the vertical axis pin beside the barrel in the disclosed launcher. The barrel 15 including its rear side can be then swung out from the weapon at a specified pivot angle. The dead cartridge case is easier to remove. Also, this construction permits the necessary height of the attachable grenade launcher 13 to be kept to a minimum dimension.

The disclosed launcher construction, however, excludes the possibility that the barrel 15 can optionally be swung out either to the right or to the left for a given construction. The swinging out of the back end of the barrel 15 is done in one example toward the left. A left handed marksman must then become accustomed to remove the cartridge casing with his free (left) hand and not, as a right hander would do, with the hand which supports the rifle 1. For this case, however, a simple spring-device 49 is provided, which activates or assists the swing-out of the barrel since the swing-out is always done toward the same side for a given launcher design. The launcher can be design for a left side swing out from a left side elongate slot in the connection piece.

The prior known grenade launcher possesses the disadvantage mentioned in the introductory passages that a rifle equipped with an attachable grenade launcher, when reloaded, must always be moved out of its position. This disadvantage is avoided in large measure by the disclosed grenade launcher 13 because the barrel 15 swings out to the side. In any case, before reloading, a small raising of the forward part of the rifle 1 is necessary.

For weight savings, the prior known grenade launcher has no integral hand grip. An unfavorable grip of the trigger-hand about the rifle magazine is utilized instead. The trigger cannot be too difficult to pull then because a bulls-eye sure activation of a resistant trigger is not possible with such an unfavorable grip. A quicker responding trigger, on the other hand, is always a safety risk.

In contrast, the disclosed grenade launcher 13 provides a trigger restraining mechanism 23 making the trigger more resistant to pull than the trigger 21 of the known grenade launcher. On the other hand, an essential advantage in safety has been achieved by the trigger restraining mechanism 23. The trigger restraining device 23 in the disclosed launcher remains always active, except immediately before firing. Beyond this, the restraining device is so difficult to move, that a thin branch which engages the trigger 21 upon traversing through a bushy area, will not pull the trigger. Naturally, the trigger restraining mechanism is so conceived that in the restricted condition the firing pin of the mechanism is always in its rear position. For example, in the case of a rebound lock, the firing pin does not extend at all through the fire hole of the impact plate.

Such a trigger restraining mechanism 23 needs no further safety means. If, nevertheless, a safety device is still desired or required, then a simple device that blocks the trigger will suffice. This is because the firing pin, even when mechanically damaged, cannot strike without a powerful activation of the trigger 21.

Advantageously, the disclosed grenade launcher has a hand grip 19 as described at greater length above. Such a grip, for example, a hand grip 19 formed anatomically, makes it possible to fire a grenade in spite of the trigger restriction and without any deterioration of aiming precision. With the prior known disadvantageously formed grip, for example, the magazine used as a handle, bullseye precision is made difficult when the trigger is pulled.

For latching and unlatching the barrel, a mechanism 53 is required which is in an idle position when the barrel is in the firing position. Activation of this mechanism results in the barrel 15 swinging out by spring action. As a matter of preference, no further action of the mechanism is required for the return motion of the barrel into its shooting position. In this case, the barrel latches in the firing position automatically. Such mechanisms are known in a great number of breakaway weapons, yet most of these mechanism are very complicated.

In the disclosed launcher, a spring equipped barrel release tripper lever 53 is provided. The tripper lever can tilt about a pivotal axis that extends a distance from the vertical pin 31 and is perpendicular to the centerline of the bore of the grenade as well as to the pin. An end of the tripper lever 53 remote from this pivotal axis engages in its rest position under spring force a protuberance on the outside of the grenade launcher 13, near to the rear end of the launcher. If the tripper lever 53 is tilted out of its rest position, then it releases the grenade launcher barrel 15 which can then swing out by the spring loading 49.

The tripper lever 53 engages at the middle of the barrel, so that it is essentially vertically oriented beneath the centerline of the now horizontal bore of the barrel of the grenade launcher which is in its firing position. The tripper lever 53 in one example is made from a flat steel plate.

The protuberance of the grenade launcher barrel preferably has a groove-like recess 55 in the outside thereof which runs parallel to the centerline of the barrel 15 of the grenade launcher. In so far as the groove-like recess 55, as viewed in the closure direction of the grenade launcher, does not vary from its location below the grenade launcher barrel, the cylindrical shaped outer contour of the barrel acts as a directing cam for the locked end of the tripper lever. In this way, the tripper lever 53 is actuated counter to its spring arrangement upon closure of the barrel to disconnect and then falls into the protuberance or the recess.

A transverse lever can be installed onto the tripper lever, or a non-rotatable pivoting lever can be bound to the tripper lever. By means of depressing the transverse lever or tripper lever with the thumb, the tripper lever can be tipped against the bias of its own spring assembly. Preferably, the tripper lever 53 is somewhat elongate beyond its pivotal axis. A push button 57 is placed at the end of the elongation, which can be designed as a ribbed surface, such as being a ribbed end section of the sheet metal tripper lever. The push button 57 or the ribbed end section protrudes at an appropriate position extending outwardly from the breech housing and can be immediately activated with a finger when the marksman wishes to swing out the grenade launcher 13.

As already remarked above, the disclosed attachable grenade launcher 13 has its own hand grip 19, which is equipped with a trigger guard 25 to protect the trigger 21 from undesirable contact. In one example, the trigger guard 25 is made of plastic, and the hand grip 19 can be entirely or partially constructed of plastic. The presence of the hand grip brings about an increase in weight in contrast to the conventional or known attachable grenade launcher. However, the increase in weight where plastic construction is used is relatively small.

The hand grip 19 enables bulls-eye accurate activation of the restricted trigger 21 and prevents the undesired transmission of grenade launcher recoil against the magazine. The hand grip 19 also allows safe use of the attachable grenade launcher 13 without an attached rifle 1.

Beyond the hand grip 19, a position is provided within the trigger guard and in front of the trigger at which the push button 57 or ribbed end section of the tripper lever protrudes downward from above. The push button 57 can be activated by being pushed upward by the index finger of the trigger-hand. If the finger is on the trigger 21, for instance when the marksman is about to shoot, then activation of the push button should not be initiated. By means of the middle positioning of the push button in front of the trigger, an added advantage is that the disclosed attachable grenade launcher is equally comfortable for either a left or right handed marksman.

The disclosed attachable grenade launcher 13 is constructed so that it can be simply exchanged, for example, on the forward stock of another rifle designed for receiving the launcher. In one example, for this purpose in prior or known launchers, two transverse borings which penetrate a notched strip are provided. Errors in location of these borings can occur here because of the required tolerances, such as by heat expansion of the rifle components. In contrast, the disclosed launcher can have a transverse boring 51 only on the front side on the forward stock of the corresponding rifle 1, should a transverse boring be made which is in such a position that it coincides with the fastening or mounting. Insofar as the disclosed grenade launcher 13 should be attachable to different rifles, however, several corresponding borings can be provided.

An elongate opening is provided on the back side of the disclosed grenade launcher 13, on both sides, respectively, for receiving a holding pin on the corresponding rifle. If the elongate opening is open to the rear, then, instead of a holding pin, a protruding, stationary, transverse projection 47 can be constructed on the weapon. The grenade launcher 13 is then pushed onto the rifle with the elongate openings over the transverse projections 47 on the rifle and held fast by the transverse pin.

Several elongate openings can be provided if the grenade launcher is adpated for attachment to different rifle models. If so, the projections 47 can be located at different positions.

For grenade launchers, as a rule, a separate sight can be provided from the sight of the rifle. This grenade launcher sight, however, can also be installed on the rifle. Often, the launcher sight is furnished as a framing, for example, a scale sight, which permits a high elevation angle.

To simplify attachment of the grenade launcher 13 onto the rifle 1, the characteristic grenade launching sight can also be installed. For this purpose, the disclosed grenade launcher has on each side, respectively, a connection means whereby the sight holder can be attached such that the grenade launcher has a corresponding sight for either a right handed or a left handed person. Thus, the sighting equipment is appropriate for use on both sides, and/or, can be set up for attachment on either the right or left side by very simple means such as moving certain parts. The holding means for the sight can be installed on or integral with the connection piece in order to always properly place and align the grenade launcher barrel.

One advantage of the disclosed launcher is that the trigger apparatus can be provided with a safety catch that, while in its at-rest position, has no effect upon the trigger. When activated, the catch engages in the trigger assembly so that no shot can be released. This safety device, when in its active state, can immobilize the firing pin, the cocking device, or the trigger itself.

This safety device is coupled, preferably, with a trip lever in such a way that the trigger assembly is blocked if the trip lever is moved out of its at-rest position. Thus, it is assured that no cartridge can be fired when the barrel is unlocked and either ready to be swung out of its shooting position or already swung out.

Another advantage of the disclosed launcher is that the firing pin of the trigger assembly is always in its retracted, idle position if the barrel is in the process of being swung in or out. This is so that it cannot strike into the end of the cartridge or against the side edge on the breeching end of the barrel which would otherwise prevent the swinging action of the barrel.

The safety device can be constructed without an operating means so that activation of the safety device is only carried out by the trip lever. The trigger assembly is in this case only made safe as long as the trip lever is activated. The advantage of this type of construction is that the marksman need not bother with the action of the safety device. Still, as is the case with weapons totally lacking in safety means, the fullest response in firing rapidity is possible with the disclosed launcher.

However, a manual contact for the activation of the safety system can be used. The coupling with the trip lever can be of such a nature that the trip lever engages the safety system, thus securing the weapon, but subsequently, when the trip lever returns to its idle position, the weapon remains safety-secure. Before the next firing, the marksman must release the safety means. This so-called "automatic safety" has proven effective for more than 100 years and offers the greatest possible safety.

Insofar as a sight with an optical system is used, this sight can be placed behind the attachable grenade launcher. Otherwise, most of the visible range would be restricted or limited.

The rifle barrel is situated above and centrally located to the connection piece in the case of the disclosed attachable grenade launcher. Insofar as a gas operated piston unit is provided on the rifle, this is generally found above the barrel of the rifle. If desired, the grenade launcher can be equipped with a supplementary hand protector which corresponds in action or function to the upper part of the rifle forward stock, but yet conforms to the grenade launcher wherein the connection piece is bulged outwardly, thus encapsulating the gas piston unit.

Although certain apparatuses constructed in accordance with the teachings of the present invention have been described herein, the scope of coverage of this patent is not limited thereto. On the contrary, this patent covers all embodiments of the teachings of the invention fairly falling within the scope of the appended claims, either literally or under the doctrine of equivalents.

What is claimed is:

1. An attachable grenade launcher for installation on a rifle, the grenade launcher comprising:

a grenade launching barrel pivotable about a stationary pin located near a muzzle of the barrel wherein the stationary pin is positioned laterally beside the grenade launcher barrel and is oriented vertically so that the grenade launching barrel can be swung out to a side opposite to said stationary pin;

a breech housing incorporating an impact plate;

a trigger assembly carried by the breech housing and incorporating a trigger; and a connection piece having a longitudinal slot and being integrally bound to the breech housing and carrying the stationary pin, wherein the connection piece circumferentially encapsulates the grenade launching barrel over at least a part of its length in such a manner that permits the grenade launching barrel to pivot about the stationary pin between a swung out position and a non-swung out position.

2. An attachable grenade launcher as defined in claim 1, wherein the breech housing has a vertical strip laterally projecting toward the longitudinal slot, and wherein the grenade launching barrel has a back end and a backwardly projecting extension on the back end, the extension having a groove that engages the strip of the grenade launching barrel when in the non-swung out position.

3. An attachable grenade launcher as defined in claim 2, wherein the groove has a rear surface, and wherein the rear surface of the groove and a rear surface of the projecting strip are constructed each as a part of a cylindrical outer surface, and wherein the surfaces thereof closely fit against one another when the grenade launching barrel is in the non-swung out position.

4. An attachable grenade launcher as defined in claim 1, wherein the longitudinal slot is open at a forward end so that the connection piece is a U-shaped structural channel.

5. An attachable grenade launcher as defined in claim 1, wherein the connection piece has at least one cut-out opening for weight reduction.

6. An attachable grenade launcher as defined in claim 1, wherein the grenade launcher barrel has a back side and two excisions on the back side situated in opposition to one another, the excisions penetrating a barrel wall of the grenade launching barrel from the rear.

7. An attachable grenade launcher as defined in claim 1, wherein the grenade launcher barrel is pivotable to a left side of the grenade launcher.

8. An attachable grenade launcher as defined in claim 1, wherein the trigger assembly has a trigger restraining apparatus.

9. An attachable grenade launcher as defined in claim 1, further comprising a spring loaded tripper lever with one end engaged in a groove on the outer side of the grenade launcher barrel near the rear end thereof in an at-rest position, wherein this engagement is released upon overcoming a spring force.

10. An attachable grenade launcher as defined in claim 9, wherein the tripper lever extends along a pivotal axis to a free end and wherein a pushbutton is placed near the free end.

11. An attachable grenade launcher as defined in claim 10, wherein the breech housing has a hand grip with a trigger guard, and wherein the pushbutton protrudes from above into a space between the trigger and the trigger guard.

12. An attachable grenade launcher as defined in claim 9, further comprising a safety apparatus that permits release of the trigger assembly in an at-rest condition of the safety apparatus, and prevents release of the trigger assembly when the safety apparatus is in an activated state.

13. An attachable grenade launcher as defined in claim 12, wherein the safety apparatus is coupled with the tripper lever and is moved by the tripper lever into the activated state when the tripper lever leaves its at-rest position.

14. An attachable grenade launcher as defined in claim 13, wherein the safety apparatus dwells in a secured operational state when the tripper lever returns to its at-rest position and wherein a manually operated means is provided for activating the safety apparatus independently of the tipper level.

15. An attachable grenade launcher as defined in claim 1, wherein the breech housing has a hand grip with a trigger guard.

16. An attachable grenade launcher as defined in claim 1, further comprising:

at least two transverse borings placed on a forward side of the launcher above the grenade launching barrel; and one fastening pin for being received in a selected one of the two transverse borings, wherein each non-selected transverse boring is closed, and wherein a back side thereof is a horizontally running elongated slot which is open toward the rear.

17. An attachable grenade launcher as defined in claim 1, further comprising at least one sight holder on each of its two sides for optional right or left side installation of a sight apparatus.

* * * * *